US006765459B2

(12) United States Patent
Hirai et al.

(10) Patent No.: US 6,765,459 B2
(45) Date of Patent: Jul. 20, 2004

(54) LAMINATED DIELECTRIC RESONATOR AND LAMINATED DIELECTRIC FILTER

(75) Inventors: Takami Hirai, Nishikamo-Gun (JP); Yasuhiko Mizutani, Komaki (JP); Kazuyuki Mizuno, Kasugai (JP); Hitoshi Saito, Saku (JP); Takeshi Noguchi, Saku (JP)

(73) Assignees: NGK Insulators, Ltd., Nagoya (JP); Soshin Electric Co., Ltd., Saku (JP)

( * ) Notice: Subject to any disclaimer, the term of this patent is extended or adjusted under 35 U.S.C. 154(b) by 2 days.

(21) Appl. No.: 10/085,833

(22) Filed: Feb. 28, 2002

(65) Prior Publication Data

US 2002/0121946 A1 Sep. 5, 2002

(30) Foreign Application Priority Data

Mar. 5, 2001 (JP) ..... 2001-060643

(51) Int. Cl.[7] ..... H01P 1/203; H01P 7/08
(52) U.S. Cl. ..... 333/204; 333/134; 333/219
(58) Field of Search ..... 333/134, 204, 333/205, 219

(56) References Cited

U.S. PATENT DOCUMENTS 5,293,140 A * 3/1994 Higgins ..... 333/204
5,497,130 A * 3/1996 Hirai et al. ..... 333/204

FOREIGN PATENT DOCUMENTS

EP 0 843 374 A2 5/1998
JP 10209707 A * 8/1998 ..... H01P/1/203
JP 11284406 A * 10/1999 ..... H01P/1/203
JP 11355008 A * 12/1999 ..... H01P/1/203

* cited by examiner

*Primary Examiner*—Robert Pascal
*Assistant Examiner*—Dean Takaoka
(74) *Attorney, Agent, or Firm*—Burr & Brown

(57) ABSTRACT

A space is defined in a portion of an overlapping region where an open end portion of a resonant electrode and an inner-layer ground electrode, of a dielectric layer which is interposed between the resonant electrode and the inner-layer ground electrode. A space is defined in a portion of an overlapping region where the open end portion of the resonant electrode and another inner-layer ground electrode, of a dielectric layer which is interposed between the resonant electrode and the other inner-layer ground electrode. These spaces are filled with respective members having a dielectric constant higher than the dielectric layers.

14 Claims, 10 Drawing Sheets

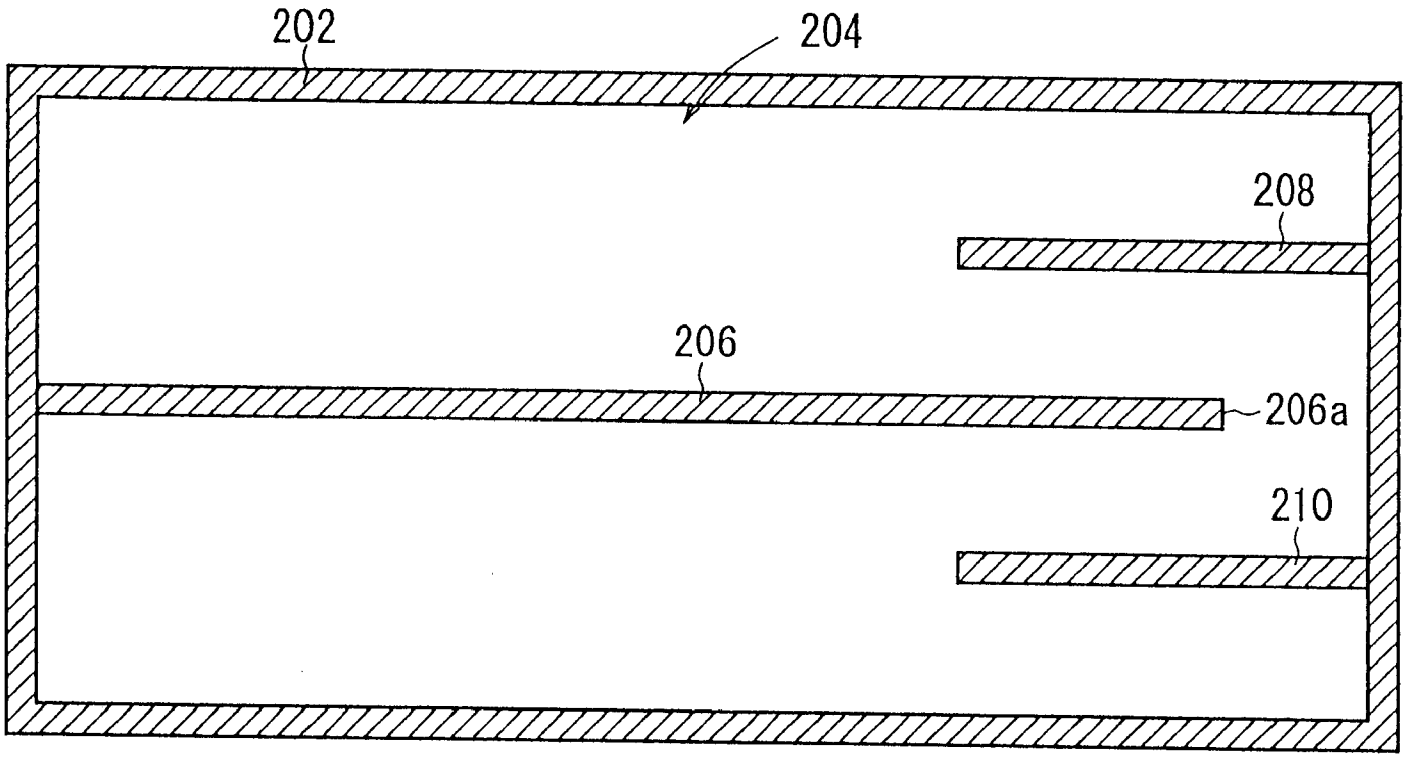
FIG. 10 - PRIOR ART

LAMINATED DIELECTRIC RESONATOR AND LAMINATED DIELECTRIC FILTER

BACKGROUND OF THE INVENTION

1. Field of the Invention

The present invention relates to a laminated dielectric resonator and a laminated dielectric filter for constituting a resonant circuit for use in a microwave band ranging from several hundred MHz to several GHz, and more particularly to a laminated dielectric resonator which can be manufactured with reduced variations and which enables a laminated dielectric filter, etc. to be reduced in size and manufactured with an increased yield, and a laminated dielectric filter.

2. Description of the Related Art

There has been a growing demand for small-size and lower-loss laminated dielectric filters in view of a wide variety of radio communication systems such as portable telephone sets available in the art.

Smaller sizes of laminated dielectric filters can be achieved by reducing the size of resonators (resonant electrodes) used therein.

For reducing the size of a resonator, it has been customary to add a capacitance to an open end of a resonant electrode. For example, as shown in FIG. 10 of the accompanying drawings, a laminated dielectric filter 200 has a resonant electrode 206 formed in a dielectric substrate 204 with a ground electrode 202 disposed on its surfaces, and a plurality of inner-layer ground electrodes 208, 210 formed in the dielectric substrate 204. The inner-layer ground electrodes 208, 210 sandwich an open end 206*a* of the resonant electrode 206.

Because of the inner-layer ground electrodes 208, 210 that overlap a portion of the open end of the resonant electrode 206 with a dielectric layer interposed therebetween, the impedance of the resonator or resonant electrode 206 is changed to make the resonator smaller in size. As the size of the resonator is smaller, however, the area in which the inner-layer ground electrodes 208, 210 overlap the portion of the open end of the resonant electrode 206 is smaller. Therefore, in order to lower the impedance of the resonator, or particularly the impedance of the open end thereof, it is necessary to reduce the thickness of the dielectric layer interposed between the resonant electrode 206 and the inner-layer ground electrodes 208, 210.

With the overlapping area being smaller, however, if the inner-layer ground electrodes 208, 210 are misaligned with each other in overlapping relation to the resonant electrode 206, the capacitance between the resonant electrode 206 and the inner-layer ground electrodes 208, 210 is greatly changed. Such capacitance changes tend to cause variations in dimensions of laminated dielectric filters that are manufactured, resulting in characteristic variations thereof.

SUMMARY OF THE INVENTION

It is therefore an object of the present invention to provide a laminated dielectric resonator and a laminated dielectric filter which are designed to suppress characteristic variations due to a misalignment between inner-layer ground electrodes in overlapping relation to a resonant electrode, and also to enable the laminated dielectric filter, etc. to be manufactured with an increased yield.

According to the present invention, a laminated dielectric resonator comprises a dielectric substrate comprising a plurality of laminated dielectric layers and an inner-layer ground electrode and a resonant electrode which are disposed in the dielectric substrate. The dielectric substrate includes a portion in an overlapping region where an open end portion of the resonant electrode and the inner-layer ground electrode overlap each other. The portion has a dielectric constant higher than another portion of the dielectric substrate.

The value of capacitance between the resonant electrode and the inner-layer ground electrode is governed by the portion in the overlapping region where the open end portion of the resonant electrode and the inner-layer ground electrode overlap each other. Therefore, even if the inner-layer ground electrode is misaligned in overlapping relation to the resonant electrode, only the overlapping area of the portion having a lower dielectric constant is changed. Therefore, any change in the value of capacitance between the resonant electrode and the inner-layer ground electrode is small.

With the laminated dielectric resonator according to the present invention, characteristic variations due to a misalignment of the inner-layer ground electrode in overlapping relation to the resonant electrode are suppressed, and the laminated dielectric filter, etc. can be manufactured with an increased yield.

In the above laminated dielectric resonator, a space may be defined in the portion of the dielectric substrate in the overlapping region and filled with a member having a dielectric constant higher than the dielectric layer interposed between the resonant electrode and the inner-layer ground electrode.

The above space which is filled with the above member is highly effective in producing the above arrangement in which the dielectric constant of the portion in the overlapping region where the open end portion of the resonant electrode and the inner-layer ground electrode overlap each other is higher than the other portion of the dielectric substrate.

The member may have an end held in contact with or close to the resonant electrode and an opposite end held in contact with or close to the inner-layer ground electrode.

According to the present invention, a laminated dielectric filter comprises a dielectric substrate comprising a plurality of laminated dielectric layers and a resonant electrode and another electrode which are disposed in the dielectric substrate. The dielectric substrate includes a portion in an overlapping region where an open end portion of the resonant electrode and the other electrode overlap each other. The portion has a dielectric constant higher than another portion of the dielectric substrate.

Accordingly, characteristic variations due to a misalignment of the inner-layer ground electrode in overlapping relation to the resonant electrode are suppressed, and the laminated dielectric filter can be manufactured with an increased yield.

In the laminated dielectric filter, the other electrode may comprise an inner-layer ground electrode. The resonant electrode may comprise a plurality of resonant electrodes. The other electrode may comprise a coupling adjusting electrode disposed in the dielectric substrate for adjusting the coupling between the resonant electrodes.

Alternatively, the resonant electrode may comprise a plurality of resonant electrodes. The other electrode may comprise either one or both of an input electrode and an output electrode. The input electrode may be disposed in the dielectric substrate and capacitively couple one of the resonant electrodes which serves as an input resonant electrode to an input terminal. The output electrode may be disposed in the dielectric substrate and capacitively couple the other of the resonant electrodes which serves as an output resonant electrode to an output terminal.

The above and other objects, features, and advantages of the present invention will become more apparent from the following description when taken in conjunction with the accompanying drawings in which preferred embodiments of the present invention are shown by way of illustrative example.

BRIEF DESCRIPTION OF THE DRAWINGS

FIG. 10 is a vertical cross-sectional of a conventional laminated dielectric resonator.

DETAILED DESCRIPTION OF THE INVENTION

Laminated dielectric resonators and laminated dielectric filters according to embodiments and modifications of the present invention will be described below with reference to FIGS. 1 through 9.

Figure 1:
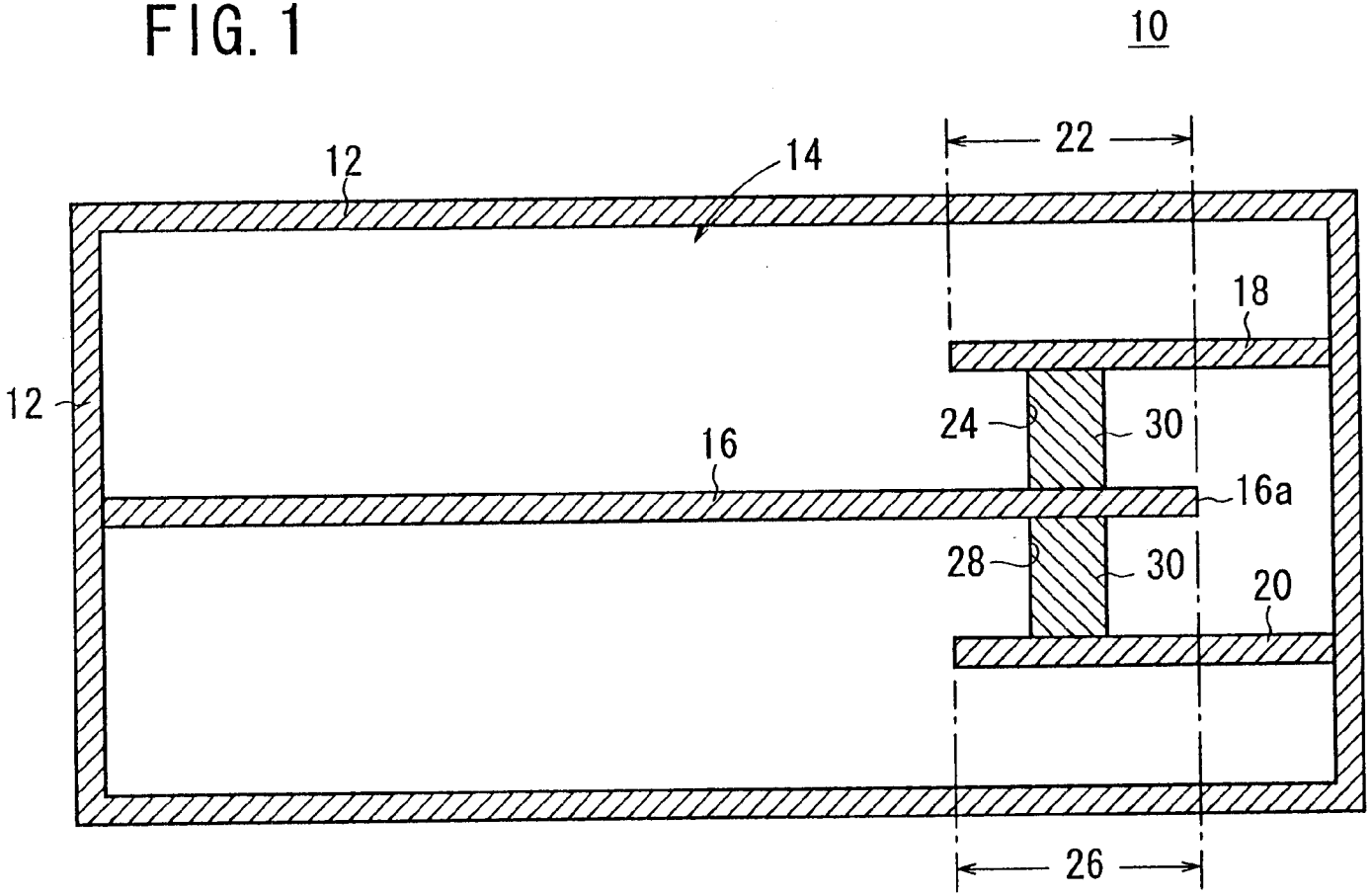
FIG. 1 is a vertical cross-sectional view of a laminated dielectric resonator according to an embodiment of the present invention.
Figure 2:
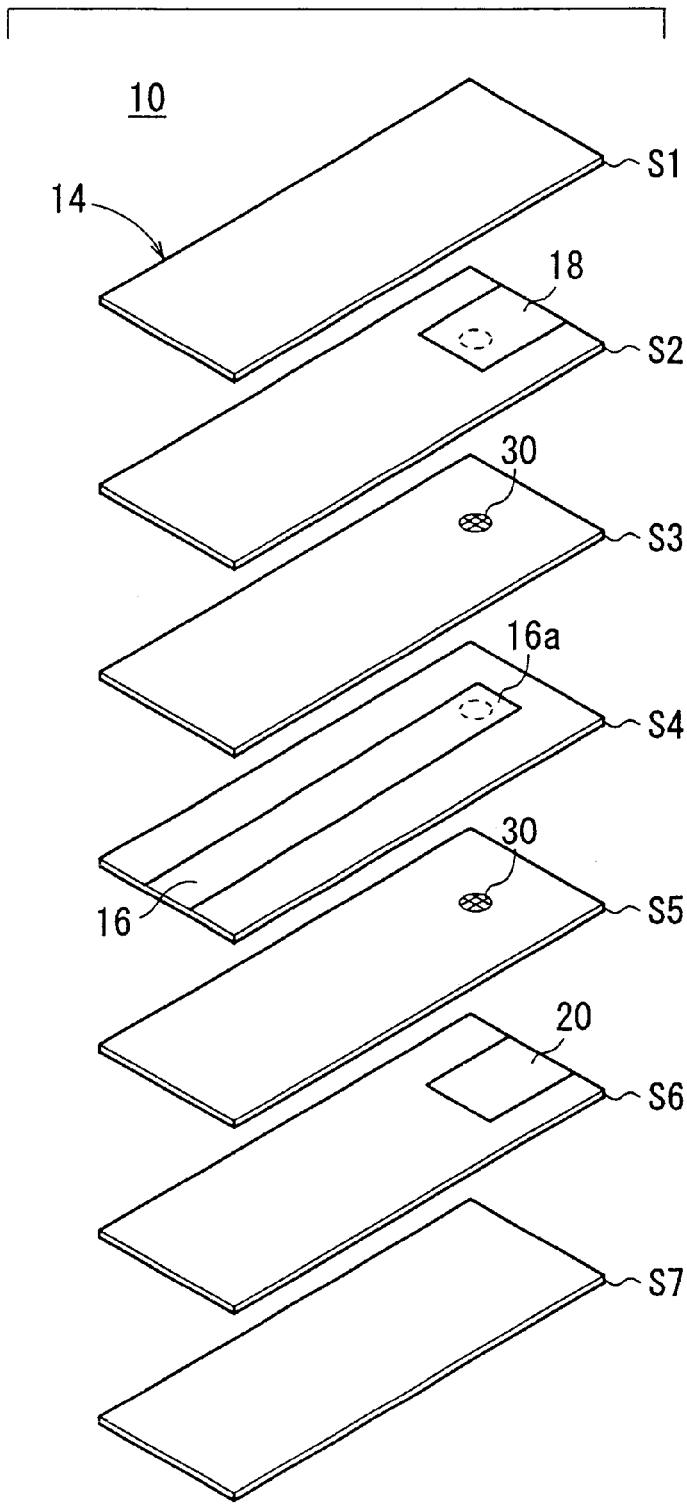
FIG. 2 is an exploded perspective view of the laminated dielectric resonator according to the embodiment of the present invention.

As shown in FIGS. 1 and 2, a laminated dielectric resonator 10 according to an embodiment of the present invention has a dielectric substrate 14 comprising a plurality of dielectric layers S1 through S7 (see FIG. 2) laminated and sintered into a unitary assembly, with a ground electrode 12 disposed on its surfaces, and a resonant electrode 16 and a plurality of inner-layer ground electrodes 18, 20 formed in the dielectric substrate 14.

In FIG. 2, the resonant electrode 16 is disposed on one principal surface of the fourth dielectric layer S4. The inner-layer ground electrodes 18, 20 are disposed on respective principal surfaces of the second and sixth dielectric layers S2, S6.

If the resonant electrode 16 comprises a quarter-wave resonant electrode, as shown in FIG. 1, a portion of the ground electrode 12 is disposed on the side surface of the dielectric substrate 14 where the resonant electrode 16 is exposed. An outer end of the resonant electrode 16 is short-circuited to that portion of the ground electrode 12.

The resonant electrode 16 has an inner open end 16*a* held capacitively coupled to the ground electrode 12 through the inner-layer ground electrodes 18, 20. Therefore, the electrical length of the resonant electrode 16 is reduced, resulting in a reduction in the size of the laminated dielectric resonator 10.

Figure 3:
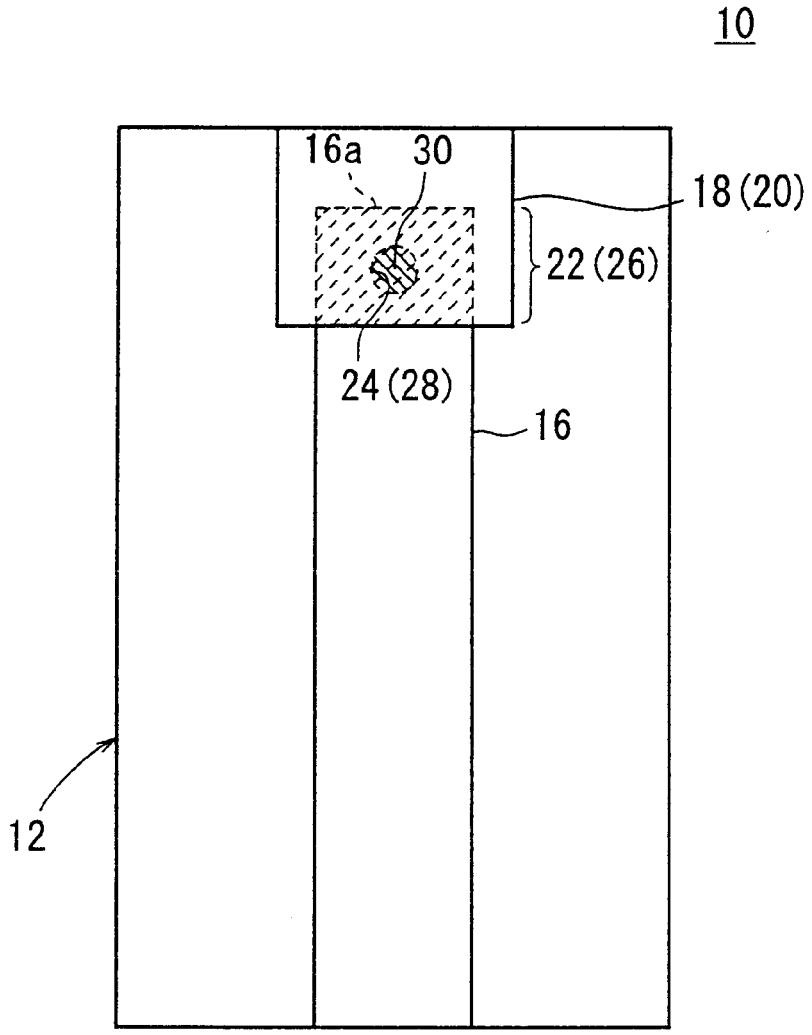
FIG. 3 is a plan view of the laminated dielectric resonator according to the embodiment of the present invention.

As shown in FIGS. 1 through 3, a space 24 is defined in an overlapping region 22 (shown hatched by the broken lines in FIG. 3) where the open end portion of the resonant electrode 16 and the inner-layer ground electrode 18 overlap each other, of the second and third dielectric layers S2, S3 which are disposed between the resonant electrode 16 and the inner-layer ground electrode 18, and a space 28 is defined in an overlapping region 26 where the open end portion of the resonant electrode 16 and the inner-layer ground electrode 20 overlap each other, of the fourth and fifth dielectric layers S4, S5 which are disposed between the resonant electrode 16 and the inner-layer ground electrode 20. The spaces 24, 28 are filled with respective members 30. The members 30 have a dielectric constant higher than the second through fifth dielectric layers S2 through S5. For example, if the second through fifth dielectric layers S2 through S5 have a dielectric constant of 7 or 25, the members 30 have a dielectric constant of 80.

The value of capacitance between the resonant electrode 16 and the inner-layer ground electrodes 18, 20 is determined by the area, thickness, and dielectric constant of the overlapping regions 22, 26 which are disposed between the open end portion of the resonant electrode 16 and the inner-layer ground electrodes 18, 20. In the present embodiment, the members 30 of high dielectric constant are filled in the portions, i.e., the spaces 24, 28, of the overlapping regions 22, 26. Therefore, the value of capacitance between the resonant electrode 16 and the inner-layer ground electrodes 18, 20 is equal to the sum of the value of capacitance of the portions of the overlapping regions 22, 26 which are filled with the members 30 and the value of capacitance of the portions of the overlapping regions 22, 26 which are free of the members 30.

Of these values of capacitance, the value of capacitance of the portions of the overlapping regions 22, 26 which are filled with the members 30 is greater than the value of capacitance of the portions of the overlapping regions 22, 26 which are free of the members 30 because the members 30 are made of a material having a higher dielectric constant. As a result, the combined capacitance between the resonant electrode 16 and the inner-layer ground electrodes 18, 20 is governed by the value of capacitance of the portions of the overlapping regions 22, 26 which are filled with the members 30.

If the inner-layer ground electrodes 18, 20 are misaligned with each other in overlapping relation to the resonant electrode 16, only the overlapping area of the portions having a lower dielectric constant is changed. Therefore, even when the inner-layer ground electrodes 18, 20 are misaligned with each other in overlapping relation to the resonant electrode 16, almost no change occurs in the value of capacitance of the portions of the overlapping regions 22, 26 which are filled with the members 30. Consequently, any change in the value of capacitance between the resonant electrode 16 and the inner-layer ground electrodes 18, 20 is small.

With the laminated dielectric resonator 10 according to the present embodiment, therefore, characteristic variations thereof due to a misalignment between the inner-layer ground electrodes 18, 20 in overlapping relation to the resonant electrode 16 are suppressed, and laminated dielectric filters can be manufactured, using the laminated dielectric resonator 10, with an increased yield.

Figure 4:
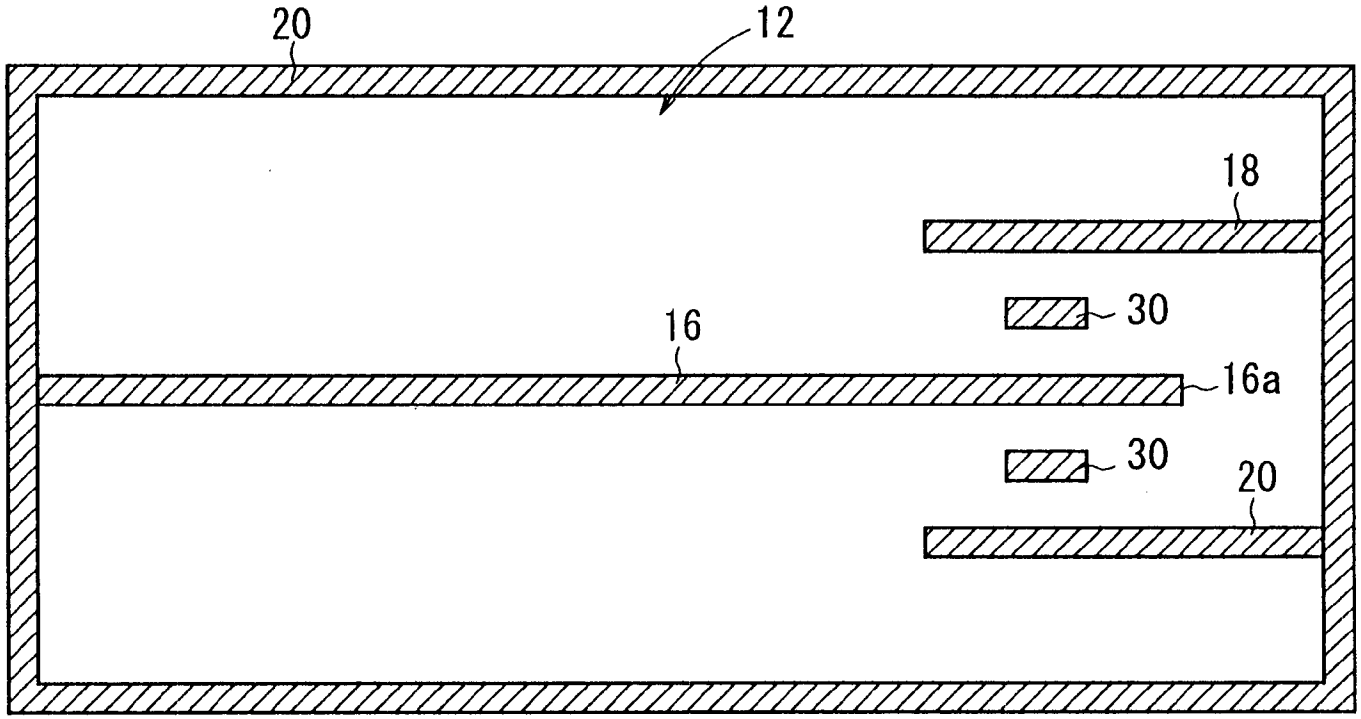
FIG. 4 is a vertical cross-sectional of a laminated dielectric resonator according to a modification of the present invention.

In the above embodiment, as shown in FIG. 1, the members 30 having a higher dielectric constant than the second through fifth dielectric layers S2 through S5 are filled in the spaces 24, 28 in contact with the inner-layer ground electrodes 18, 20 and the resonant electrode 16. However, as shown in FIG. 4, members 30 having a higher dielectric constant than the second through fifth dielectric layers S2 through S5 may be filled out of contact with and near the inner-layer ground electrodes 18, 20 and the resonant electrode 16.

A two-stage laminated dielectric filter 100 using the structure of the above laminated dielectric resonator 10 will be described below with reference to FIGS. 5 and 6.

Figure 5:
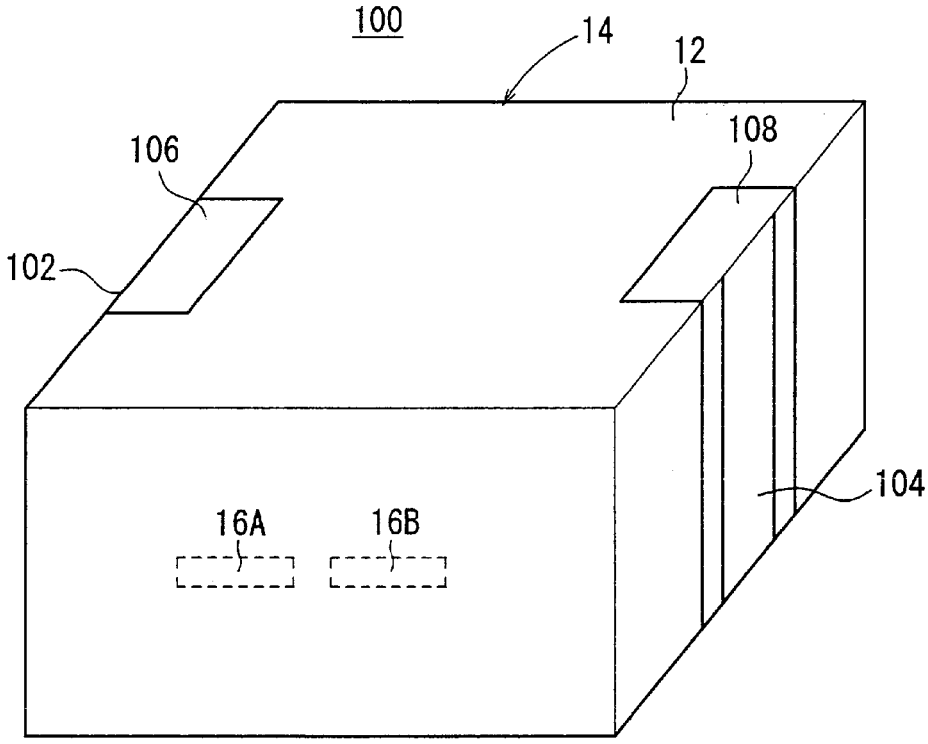
FIG. 5 is a perspective view of a laminated dielectric filter according to an embodiment of the present invention.

As shown in FIG. 5, the two-stage laminated dielectric filter 100 has a dielectric substrate 14 comprising a plurality of dielectric layers S1 through S9 (see FIG. 6) laminated and sintered into a unitary assembly, with a ground electrode 12 disposed on its surfaces, and two resonant electrodes 16A, 16B formed in the dielectric substrate 14.

An input terminal 102 is disposed on one side surface of the dielectric substrate 14. An output terminal 104 is disposed on an opposite side surface of the dielectric substrate 14. Insulating areas 106, 108 where the dielectric substrate 14 is exposed extend between the input terminal 102 and the corresponding portion of the ground electrode 12 and between the output terminal 104 and the corresponding portion of the ground electrode 12.

If each of the resonant electrodes 16A, 16B comprises a quarter-wave resonant electrode, a portion of the ground electrode 12 is disposed on the side surface of the dielectric substrate 14 where the resonant electrodes 16A, 16B are exposed, and outer ends of the resonant electrodes 16A, 16B are short-circuited to that portion of the ground electrode 12.

Figure 6:
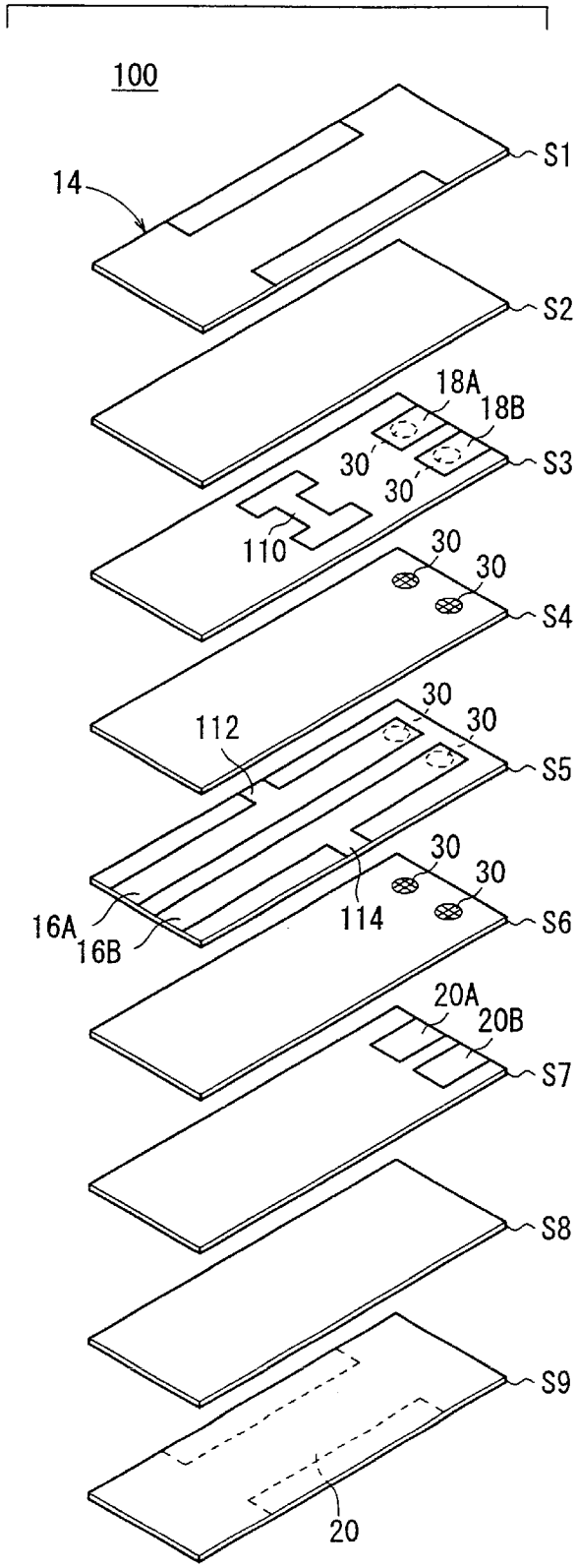
FIG. 6 is an exploded perspective view of the laminated dielectric filter according to the embodiment of the present invention.

As shown in FIG. 6, inner-layer ground electrodes 18A, 18B are disposed on one principal surface of the third dielectric layer S3 at respective positions overlying and covering the open ends of the resonant electrodes 16A, 16B. A coupling adjusting electrode 110 for adjusting the coupling between the resonant electrodes 16A, 16B is also disposed on the same principal surface of the third dielectric layer S3.

The resonant electrodes 16A, 16B are disposed on one principal surface of the fourth dielectric layer S5. The resonant electrode 16A, which serves as an input resonant electrode, is connected to the input terminal 102 (see FIG. 5) by a lead electrode 112. The resonant electrode 16B, which serves as an output resonant electrode, is connected to the output terminal 104 (see FIG. 5) by a lead electrode 114.

Inner-layer ground electrodes 20A, 20B are disposed on one principal surface of the seventh dielectric layer S7 at respective positions underlying and covering the open ends of the resonant electrodes 16A, 16B.

Spaces are defined in overlapping regions where the open end portions of the resonant electrodes 16A, 16B and the inner-layer ground electrodes 18A, 18B overlap each other, of the third and fourth dielectric layers S3, S4. These spaces are filled with respective members 30 which have a dielectric constant higher than the third and fourth dielectric layers S3, S4.

Similarly, spaces are defined in overlapping regions where the open end portions of the resonant electrodes 16A, 16B and the inner-layer ground electrodes 20A, 20B overlap each other, of the fifth and sixth dielectric layers S5, S6. These spaces are filled with respective members 30 which have a dielectric constant higher than the fifth and sixth dielectric layers S5, S6.

The two-stage laminated dielectric filter 100 employs the structure of the above laminated dielectric resonator 10. Therefore, variations which tend to occur when the two-stage laminated dielectric filter 100 is manufactured are suppressed, and the two-stage laminated dielectric filter 100 can be reduced in size and manufactured with an increased yield.

Modifications of the two-stage laminated dielectric filter 100 will be described below with reference to FIGS. 7 through 9.

Figure 7:
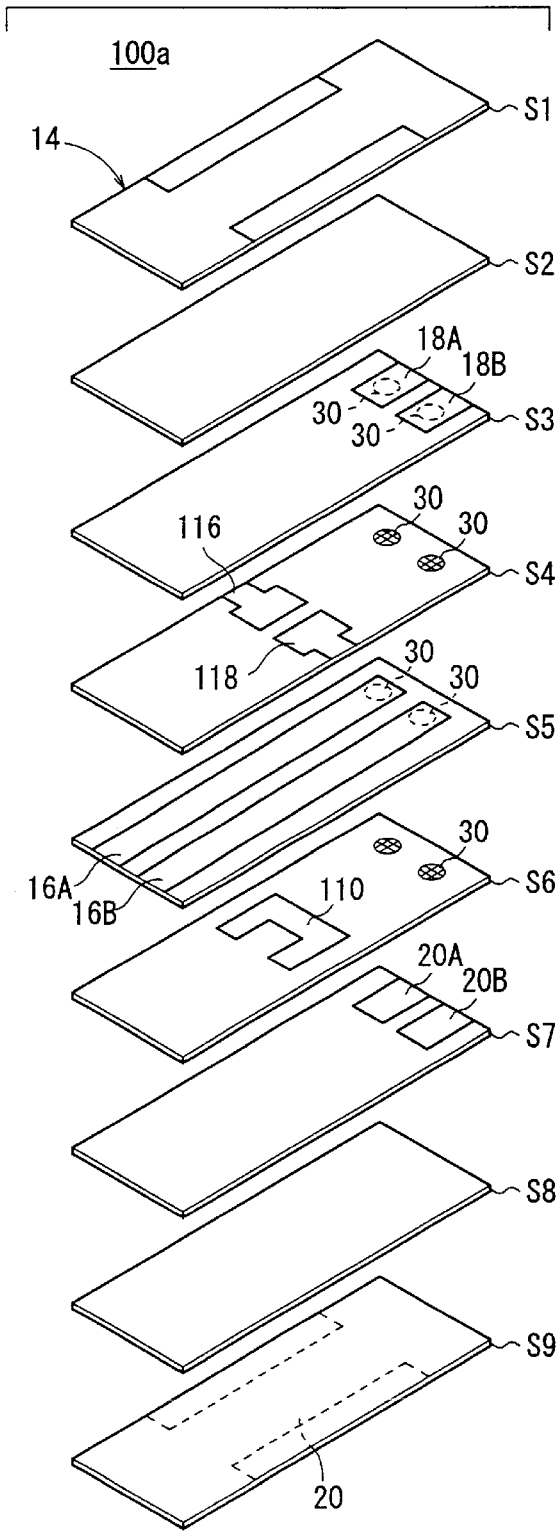
FIG. 7 is an exploded perspective view of a laminated dielectric filter according to a first modification of the present invention.

FIG. 7 shows in exploded perspective a two-stage laminated dielectric filter 100*a* according to a first modification of the present invention. Though the two-stage laminated dielectric filter 100*a* is essentially similar to the two-stage laminated dielectric filter 100, as shown in FIG. 7, the two-stage laminated dielectric filter 100*a* differs from the two-stage laminated dielectric filter 100 in that an input electrode 116 capacitively coupling the input resonant electrode 16A to the input terminal 102 and an output electrode 118 capacitively coupling the output resonant electrode 16B to the output terminal 104 are disposed on one principal surface of the fourth dielectric layer S4, and a coupling adjusting electrode 110 is disposed on one principal surface of the sixth dielectric layer S6.

Figure 8:
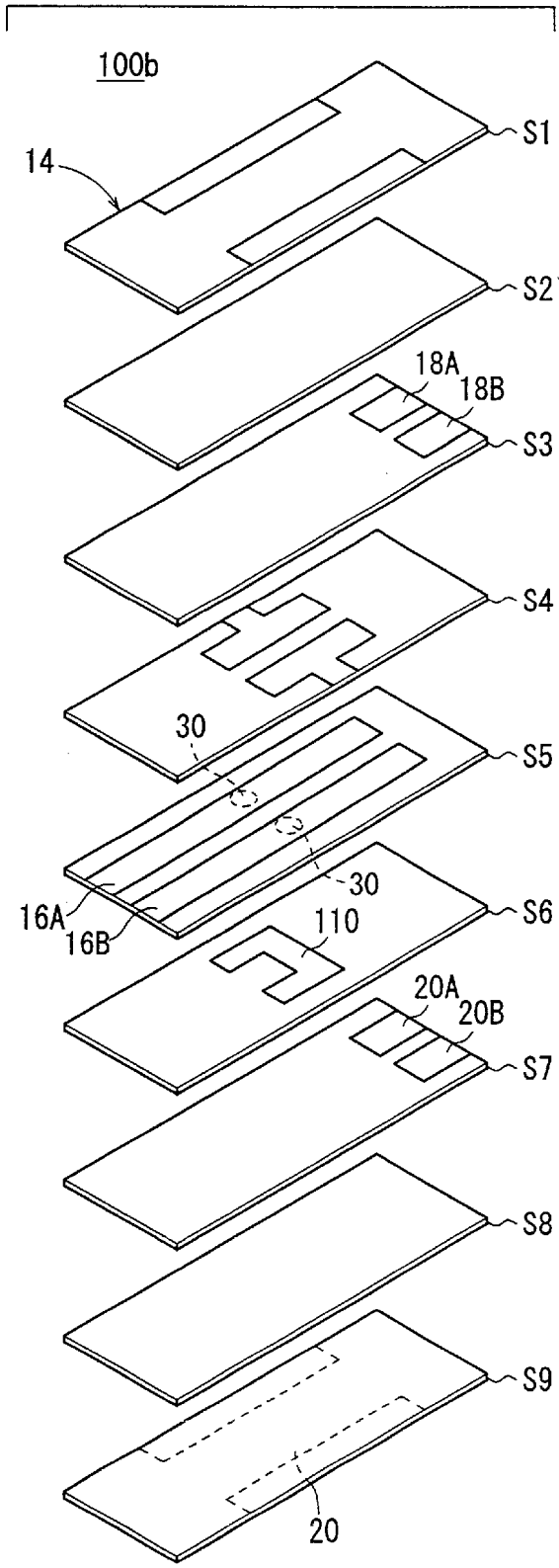
FIG. 8 is an exploded perspective view of a laminated dielectric filter according to a second modification of the present invention.

FIG. 8 shows in exploded perspective a two-stage laminated dielectric filter 100*b* according to a second modification of the present invention. The two-stage laminated dielectric filter 100*b* is essentially similar to the two-stage laminated dielectric filter 100*a* according to the first modification, but differs therefrom as follows:

Spaces are defined in overlapping regions where the resonant electrodes 16A, 16B and the coupling adjusting electrode 110 overlap each other, of the fifth dielectric layer S5 which is interposed between the resonant electrodes 16A, 16B and the coupling adjusting electrode 110. These spaces are filled with respective members 30 which have a dielectric constant higher than the fifth dielectric layer S5.

Figure 9:
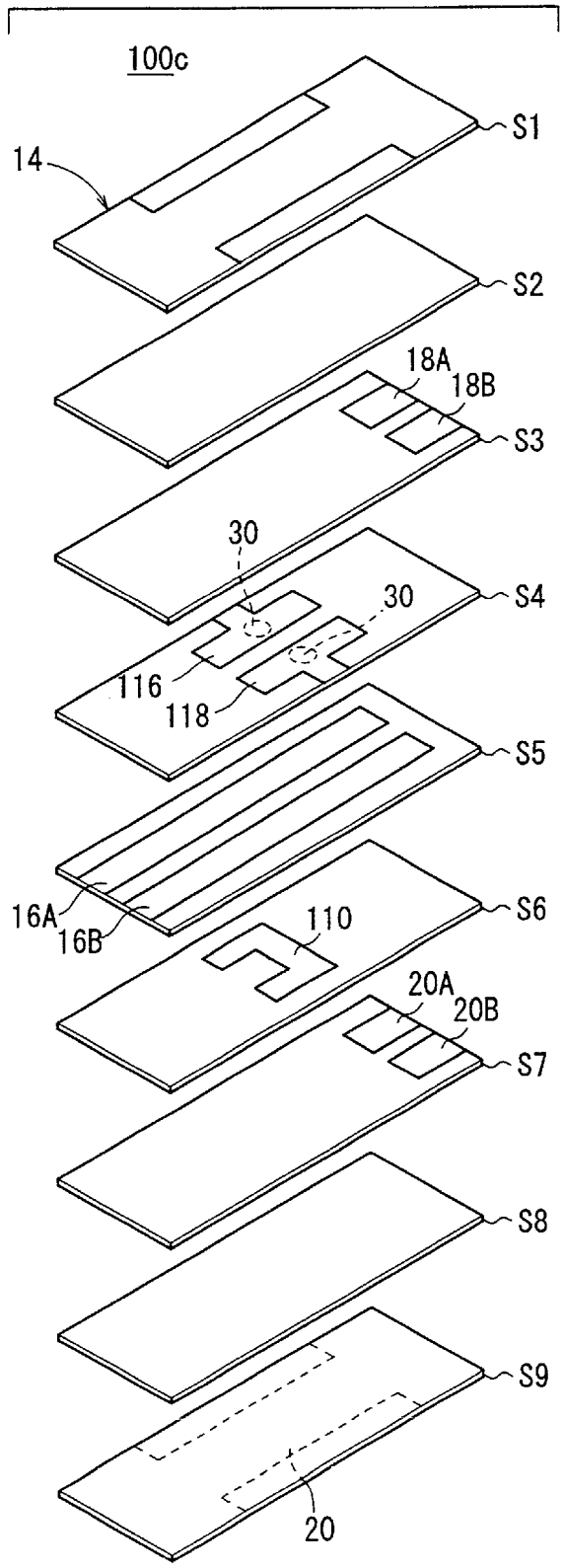
FIG. 9 is an exploded perspective view of a laminated dielectric filter according to a third modification of the present invention.

FIG. 9 shows in exploded perspective a two-stage laminated dielectric filter 100*c* according to a third modification of the present invention. The two-stage laminated dielectric filter 100*c* is essentially similar to the two-stage laminated dielectric filter 100*a* according to the first modification, but differs therefrom as follows:

Spaces are defined in overlapping regions where the input resonant electrode 16A and the input electrode 116 overlap each other and the output resonant electrode 16B and the output electrode 118 overlap each other, of the fourth dielectric layer S4 which is interposed between the resonant electrodes 16A, 16B and the input and output electrodes 116, 118. These spaces are filled with respective members 30 which have a dielectric constant higher than the fourth dielectric layer S4.

As with the above two-stage laminated dielectric filter 100, variations which tend to occur when the two-stage laminated dielectric filters 100*a* through 100*c* according to the first through third modifications are manufactured are suppressed, and the two-stage laminated dielectric filters 100*a* through 100*c* can be reduced in size and manufactured with an increased yield.

In the above embodiment and modifications, the laminated dielectric resonator 10 is applied to the two-stage laminated dielectric filters 100, 100*a* through 100*c*. However, the laminated dielectric resonator 10 is also applicable to a three-stage laminated dielectric filter or a four-stage or multiple-stage laminated dielectric filter.

With the laminated dielectric resonator and the laminated dielectric filter according to the present invention, characteristic variations due to a misalignment between inner-layer ground electrodes in overlapping relation to a resonant electrode are suppressed, and the laminated dielectric filter, etc. can be manufactured with an increased yield and in a smaller size.

Although certain preferred embodiments of the present invention have been shown and described in detail, it should be understood that various changes and modifications may be made therein without departing from the scope of the appended claims.

What is claimed is:

1. A laminated dielectric resonator, comprising:

a dielectric substrate comprising a plurality of laminated dielectric layers; and an inner-layer ground electrode and a resonant electrode disposed in said dielectric substrate, wherein said dielectric substrate includes an overlapping region in which said resonant electrode and said inner-layer ground electrode overlap each other, and wherein said overlapping region comprises a portion in which a dielectric constant is higher than another portion of said overlapping region of said dielectric substrate, said portion being in contact with said resonant electrode and said inner layer ground electrode, and extending continuously between said resonant electrode and said inner-layer ground electrode.

2. A laminated dielectric resonator according to claim 1, wherein said portion of said dielectric substrate in said overlapping region is filled with a member having a dielectric constant higher than the dielectric layer interposed between said resonant electrode and said inner-layer ground electrode.

3. A laminated dielectric resonator according to claim 2, wherein said member has an end held in contact with said resonant electrode and an opposite end held in contact with said inner-layer ground electrode.

4. A laminated dielectric filter comprising:

a dielectric substrate comprising a plurality of laminated dielectric layers; and a resonant electrode and another electrode, said resonant electrode and said another electrode being disposed in said dielectric substrate, wherein said dielectric substrate includes an overlapping region in which said resonant electrode and said another electrode overlap each other, and wherein said overlapping region comprises a portion in which a dielectric constant is higher than another portion of said overlapping region of said dielectric substrate, said portion being in contact with said resonant electrode and said another electrode, and extending continuously between said resonant electrode and said another electrode.

5. A laminated dielectric filter according to claim 4, wherein said another electrode comprises an inner-layer ground electrode.

6. A laminated dielectric filter, comprising:

a dielectric substrate comprising a plurality of laminated dielectric layers;

a plurality of resonant electrodes; and a coupling adjusting electrode disposed in said dielectric substrate for adjusting the coupling between said resonant electrodes, wherein said dielectric substrate includes an overlapping region in which said resonant electrodes and said coupling adjusting electrode overlap each other, and wherein said overlapping region comprises a portion in which a dielectric constant is higher than another portion of said overlapping region of said dielectric substrate, said portion being in contact with said resonant electrodes and said coupling adjusting electrode, and extending continuously between said resonant electrodes and said coupling adjusting electrode.

7. A laminated dielectric filter, comprising:

a dielectric substrate comprising a plurality of laminated dielectric layers;

a plurality of resonant electrodes;

an input electrode and an output electrode, said input electrode being disposed in said dielectric substrate and capacitively coupling one of said resonant electrodes which serves as an input resonant electrode to an input terminal and said output electrode being disposed in said dielectric substrate and capacitively coupling another of said resonant electrodes which serves as an output resonant electrode to an output terminals, wherein said dielectric substrate includes a first overlapping region in which said input electrode and said input resonant electrode overlap each other, and said first overlapping region comprises a first portion in which a dielectric constant is higher than another portion of said first overlapping region of said dielectric substrate, said first portion being in contact with said input electrode and said input resonant electrode, and extending continuously between said input electrode and said input resonant electrode, and wherein said dielectric substrate further includes a second overlapping region in which said output electrode and said output resonant electrode overlap each other, and said second overlapping region comprises a second portion in which a dielectric constant is higher than another portion of said second overlapping region of said dielectric substrate, said second portion being in contact with said output electrode and said output resonant electrode, and extending continuously between said output electrode and said output resonant electrode.

8. A laminated dielectric resonator comprising:

a dielectric substrate comprising a plurality of laminated dielectric layers; and an inner-layer ground electrode and a resonant electrode disposed in said dielectric substrate, wherein said dielectric substrate includes an overlapping region in which said resonant electrode and said inner-layer ground electrode overlap each other, and wherein said overlapping region comprises a portion in which a dielectric constant is higher than another portion of said overlapping region of said dielectric substrate, said portion being out of contact with said resonant electrode and said inner-layer ground electrode, and disposed between said resonant electrode and said inner-layer ground electrode.

9. A laminated dielectric resonator according to claim 8, wherein said portion of said dielectric substrate in said overlapping region is filled with a member having a dielectric constant higher than the dielectric layer interposed between said resonant electrode and said inner-layer ground electrode.

10. A laminated dielectric resonator according to claim 9, wherein said member has an end held out of contact with said resonant electrode and an opposite end held out of contact with said inner-layer ground electrode.

11. A laminated dielectric filter comprising:

a dielectric substrate comprising a plurality of laminated dielectric layers;

a resonant electrode and another electrode, said resonant electrode and said another electrode being disposed in said dielectric substrate, wherein said dielectric substrate includes an overlapping region in which said resonant electrode and said another electrode overlap each other, and wherein said overlapping region comprises a portion in which a dielectric constant is higher than another portion of said overlapping region of said dielectric substrate, said portion being out of contact with said resonant electrode and said another electrode, and disposed between said resonant electrode and said another electrode.

12. A laminated dielectric filter according to claim 11, wherein said another electrode comprises an inner-layer ground electrode.

13. A laminated dielectric filter, comprising:

a dielectric substrate comprising a plurality of laminated dielectric layers;

a plurality of resonant electrodes; and a coupling adjusting electrode disposed in said dielectric substrate for adjusting the coupling between said resonant electrodes, wherein said dielectric substrate includes an overlapping region in which said resonant electrodes and said coupling adjusting electrode overlap each other, and wherein said overlapping region comprises a portion in which a dielectric constant is higher than another portion of said overlapping region of said dielectric substrate, said portion being out of contact with said resonant electrodes and said coupling adjusting electrode, and disposed between said resonant electrodes and said coupling adjusting electrode.

14. A laminated dielectric filter, comprising:

a dielectric substrate comprising a plurality of laminated dielectric layers;

a plurality of resonant electrodes; and an input electrode and an output electrode, said input electrode being disposed in said dielectric substrate and capacitively coupling one of said resonant electrodes which serves as an input resonant electrode to an input terminal and said output electrode being disposed in said dielectric substrate and capacitively coupling another of said resonant electrodes which serves as an output resonant electrode to an output terminal, wherein said dielectric substrate includes a first overlapping region in which said input electrode and said input resonant electrode overlap each other, and said first overlapping region comprises a first portion in which a dielectric constant is higher than another portion of said first overlapping region of said dielectric substrate, said first portion being out of contact with said input electrode and said input resonant electrode, and disposed between said input electrode and said input resonant electrode, and wherein said dielectric substrate includes a second overlapping region in which said output electrode and said output resonant electrode overlap each other, and said second overlapping region comprises a second portion in which a dielectric constant is higher than another portion of said second overlapping region of said dielectric substrate, said second portion being out of contact with said output electrode and said output resonant electrode, and disposed between said output electrode and said output resonant electrode.

* * * * *